United States Patent [19]

Kitamura

[11] 4,347,699

[45] Sep. 7, 1982

[54] EXHAUST CLEANING FLUID CONTROL SYSTEM AND VACUUM CONTROL VALVE DEVICE FOR USE THEREIN

[75] Inventor: Kazuhiko Kitamura, Toyota, Japan

[73] Assignee: Aisin Seiki Kabushiki Kaisha, Kariya, Japan

[21] Appl. No.: 208,264

[22] Filed: Nov. 19, 1980

[30] Foreign Application Priority Data

Dec. 10, 1979 [JP] Japan ..... 54-159915

[51] Int. Cl.[3] ..... F01N 3/22

[52] U.S. Cl. ..... 60/290; 123/327; 123/587; 137/85; 137/DIG. 8

[58] Field of Search ..... 60/289, 290; 123/327, 123/407, 571, 568, 587; 137/85, DIG. 8

[56] References Cited

U.S. PATENT DOCUMENTS

| | | | |
|---|---|---|---|
| 2,780,230 | 2/1957 | Freeman | 137/85 |
| 3,561,410 | 2/1971 | Soeters | 123/407 |
| 3,587,617 | 6/1971 | Olsen | 137/85 |
| 3,675,633 | 7/1972 | Nakajima | 123/568 |
| 4,033,125 | 7/1977 | Inada | 60/290 |
| 4,052,996 | 10/1977 | Burrus | 137/85 |
| 4,100,735 | 7/1978 | Miyagi | 60/290 |
| 4,146,986 | 4/1979 | Kohama | 60/290 |
| 4,166,476 | 9/1979 | Yamanaka | 60/290 |
| 4,297,984 | 11/1981 | Kawabata | 123/587 |
| 4,316,479 | 2/1982 | Franz | 137/85 |

*Primary Examiner*—Douglas Hart

*Attorney, Agent, or Firm*—Oblon, Fisher, Spivak, McClelland & Maier

[57] ABSTRACT

A fluid control system for cleaning exhaust gases of an internal combustion engine by injecting additional air into the exhaust manifold of the downstream of the combustion chamber of the engine according to the engine operating conditions. This system includes a vacuum control valve which supplies vacuum on-off signals to a flow control valve device which meters injecting of additional air. The vacuum control valve device includes a housing, a diaphragm dividing the housing into a first chamber communicating with the engine intake manifold which forms a vacuum source and a second chamber communicating with atmosphere, a valve assembly securely fixed to a center portion of the diaphragm and having a passage intercommunicating the first and second chambers and a valve body normally closing the intercommunicating passage, a solenoid device provided in the second chamber for on-off driving of the diaphragm in response to on-off signals, and a stopper adapted to open the intercommunicating passage by pressing the valve body when the valve assembly is displayed by a predetermined distance for feeding vacuum signals proportional to the engine load from an output port of the housing to a flow control valve when on-off signals are supplied to the solenoid device.

8 Claims, 1 Drawing Figure

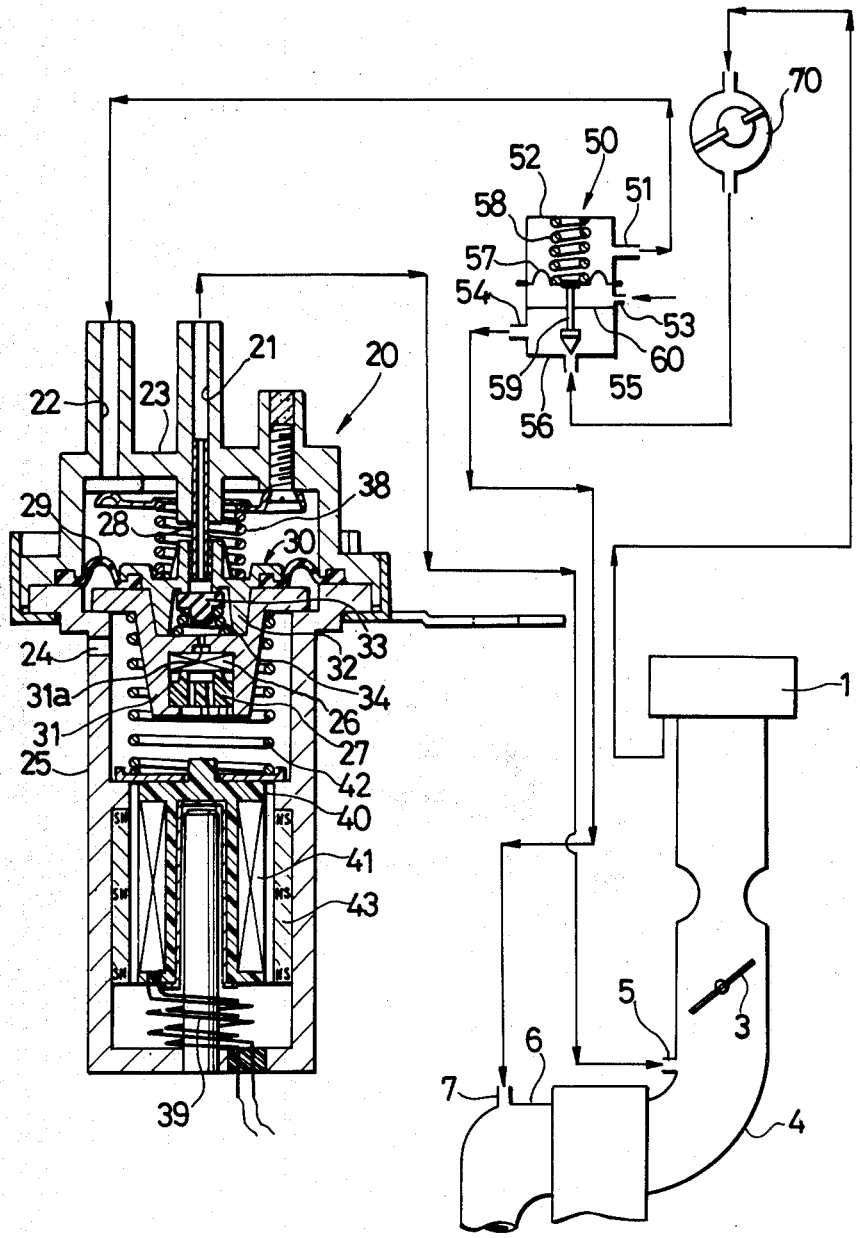
70
50
52
51
58
57
54
53
60
59
55
56
21
20
22
23
38
29
28
30
24
33
32
31a
34
31
26
27
25
42
40
41
43
39
1
5
3
6
7
4

EXHAUST CLEANING FLUID CONTROL SYSTEM AND VACUUM CONTROL VALVE DEVICE FOR USE THEREIN

BACKGROUND OF THE INVENTION

1. Field of the Invention

This invention relates to a system for adding a controlled amount of air to exhaust gases in the exhaust manifold of an internal combustion engine downstream of the combustion chamber for the purpose of cleaning the exhaust gases.

2. Description of the Prior Art

In this type of exhaust cleaning system, the flow rate of additional air to be to be fed to the engine exhaust manifold from an air pump is metered by a flow control valve in response to vacuum signals from an on-off solenoid value which is under on-off-duty control of a microcomputer operating on input signals indicative of variations in the partial oxygen pressure in the exhaust gases as detected by the oxygen sensing element, the engine r.p.m., the exhaust gas temperature, the throttle opening of the carburetor and the intake manifold vacuum. The cleaning system normally employs a vacuum control value for providing a vacuum source of a predetermined level by controlling the vacuum which is drawn from the engine intake manifold.

The controlled vacuum is fed to the on-off-duty solenoid valve thereby producing a vacuum signals for operating the flow control valve. Namely, the feed rate of additional air to the engine exhaust gases is solely controlled by the on-off-duty solenold valve operating in response to command signals from microcomputer which processes various operational variables according to predetermined arithmetic formulas. In this connection, there is a trend of increasingly relying on the microcomputer for various controls and calculations such as the instructions for economical operation of the engine and the calculation of fuel consumption, and it is presumed that the burden of the microcomputer will be increased in the future. Therefore, it is desirable to lessen the burden of the controls and calculations which are born by the microcomputer, substituting them as much as possible by mechanical or pneumatic operations.

Further, in the above-described conventional system employing a vacuum control valve which produces output vacuum of a predetermined level, the control responsive to the engine load is effected by feeding a variable to the microcomputer indicative of the engine level load and producing vacuum signals by the on-off control of the solenoid valve, resulting in a large consumption of additional air.

SUMMARY OF THE INVENTION

The present invention has its object the provision of an exhaust gas cleaning fluid control system employing a vacuum control valve under on-off control which is supplied with an input vacuum containing signal elements responsive to variations in the intake manifold vacuum of the engine, thereby lessening the burden of the microcomputer.

It is another object of the present invention to provide a solenoid-operated vacuum control valve device of simple construction for use in an exhaust cleaning system of the type mentioned above.

A still further object of the present invention to optimize the consumption of additional air and reduce the power consumption in an exhaust gas cleaning system of an internal combustion engine.

According to the present invention, there is provided an exhaust gas cleaning fluid control system for an internal combustion engine, including a flow control valve for supplying a controlled amount of additional air to the exhaust manifold of the engine in response vacuum input signals and a vacuum control valve device for producing vacuum signals to be applied to a vacuum chamber of the flow control valve, the vacuum control valve device including a housing, a diaphragm dividing the housing into a first chamber communicating with the engine intake manifold and a second chamber communicating with the atmosphere, a valve assembly secured to a center portion of the diaphragm and having an intercommunicatng passage formed therethrough to allow communication between the first and second chambers and a movable valve body biased by a spring normally to close the intercommunicating passage, first and second spring members provided in the first and second chambers, respectively, and imposing opposite spring forces on the valve assembly, a solenoid device provided in the second chamber and operated by on-off signals to apply a force to the second spring member against the action of the first spring member; a stopper adapted to press the movable valve body when the valve assembly is displaced by a predetermined distance, thereby communicating the first and second chambers with each other through the intercommunicating passage thereby producing in the first chamber vacuum signals proportional to the intake manifold vacuum of the engine and to the on-off signals applied to the solenoid device.

BRIEF DESCRIPTION OF THE DRAWING

In the accompanying drawing, the sole FIGURE is a schematic diagram of an exhaust gas cleaning system of an internal combustion engine incorporating the present invention.

DETAILED DESCRIPTION OF THE PREFERRED EMBODIMENT

An embodiment of the present invention is described hereafter with reference to the drawing.

The FIGURE is a schematic diagram of a system arrangement incorporating the present invention. In the FIGURE, indicated at 1 is an air cleaner, at 3 a throttle valve, at 4 an intake manifold, at 5 a port communicating with the intake manifold, at 6 an exhaust manifold, at 7 a port communicating with the exhaust manifold, at 20 a vacuum control valve device, at 50 a flow control valve, and at 70 an air pump. In the FIGURE, reference numerals 1 to 7 denote the aforementioned engine elements, and flow control valve 50 and air pump 70 are of known construction and of known combination. The arrows in this FIGURE indicate the direction of air flow.

Referring first to vacuum control valve device 20, such is housed in a first casing 23 with a vacuum port 21 an output port 22 and a second casing 25 of a magnetic material with an atmospheric port 24. The vacuum port 21 fixedly receives therein one end of a pipe 28. Securely gripped between the first and second casings 23 and 25 are outer peripheral edge portions of a diaphragm 29 which partitions off the inner chambers of the first and second casings 23 and 25. Securely fixed to a center portion as the diaphragm 29 is a valve member 30 which, in this particular embodiment, includes a valve seat 31, a valve cover 32, a movable valve body 33, a coil spring 34, a filter 26 and a filter holder 27, and which is integrally fixed to the diaphragm by the press-in fitting of the valve cover 32 in the valve seat 31. The movable valve body 33 is urged upwardly by the action of the compression coil spring 34 within the inner space defined by the valve seat 31 and the valve cover 32.

Valve cover 32 is centrally provided with a hole for receiving the protruding lower end portion of the pipe 28. The inner diameter of the just-mentioned hole is slightly greater than the outer diameter of the pipe 38, so that, when the diaphram 29 and valve member 30 are moved upward against the action of the compression coil spring 28, the movable valve body 33 abuts against the pipe 28 and is opened thereby upon a further upward movement of the valve member 30, communicating the inner space of the valve member 30 with the inner chamber of the first casing 23. At this time, the inner space of the valve member 30 is blocked against communication with the vacuum port 21. In the position shown in the drawing, the vacuum port 21 is in communication with the inner chamber of the first casing through a gap between the valve member 30 and pipe 28. The valve seat 31 is provided with a narrow passage 31*a* in communication with its inner space, which is in turn in communication with the atmospheric port 24 through the filter 26, holder 27 and inner space of the second casing 25, applying atmospheric pressure to the inner space defined by the valve seat 31 and over 32.

On a magnetic core 39 which has its lower end fixed at the center of the bottom wall of the first casing 23, there is fitted a coil bobbin 40 for supporting a coil winding 41 through an insulating layer. Since the bobbin 40 is movable, the lead wire of the coil 17 is taken out of the casing 25 after winding the same in the fashion of a coil spring. The bobbin 40 supports the lower end of the compression coil spring 42 of the second spring means, the upper end of which abuts against valve seat 31. Coil spring 42 urges the valve member 30 in a direction of contracting the inner space of the first asing 23 which communicates with the output port 22.

Fixedly fitted on the inner periphery of the second casing 25 which surrounds the coil winding 41 is a radially polarized cylindrical ferrite 43 as shown in the drawing. Thus, one set of solenoid device, a linear motor type solenoid device, is constituted by the lower half of the second casing 25 along with the coil bobbin 41, coil winding 41, ferrite 43 and core 39, ferrite 43 producing a magnetic field with magnetic flux flowing from the inner surface (N) of the ferrite 43 through the magnetic core 39, the bottom and the side wall of the second casing 25 to the outer surface (S) of the ferrite 43. Upon energizing coil winding 41 to produce flow of magnetic flux in that direction (from the upper to lower end of the core 39, hereinafter referred to as forward conduction), there occurs repellation between the magnetic flux generated by the coil 41 and the magnetic flux of the ferrite 43, imposing on the coil 41 and bobbin 40 a force acting in the direction of compressing the coil spring 42 proportionally to the valve of applied current. The force applied to the bobbin 40 acts on the valve member 30 through the spring 42 in a direction of contracting the inner chamber of the first casing 23.

The vacuum control valve device 20 operates in the manner as described hereafter. Now, if the coil 41 is in a de-energized state, the lower end of the coil spring 42 is not displaced and remains in the position shown in the drawing. The vacuum in the intake manifold 4 is in communication with the inner chamber of the first casing 23 through the vacuum port 21, pipe 28, a hole in the valve cover 32 and the gap around the outer periphery of the pipe 28, and a constant atmospheric pressure prevails in the inner chamber of the second casing 25 which contacts the diaphragm 29, so that the diaphragm 29 and valve member 30 are pulled upward against the action of the spring 38, contracting the inner chamber of the first casing 23. As a result, the lower end of the pipe 28 is shifted from the above into the valve member 30 and into abutting engagement with the upper face of the movable valve body 33, whereupon the movable valve body 33 is pushed downward within the valve member 30 against the force of the spring 34 to communicate the inner space of the valve member 30 with the inner chamber of the first casing 23. Consequently, air is drawn into the inner chamber of the first casing 23 through the narrow passage 31*a* and the inner space of the valve member 30, thereby increasing the pressure (or lowering the vacuum) in the chamber of the first casing 23 and pushing the valve member 30 downward by the force of the spring 38. This causes the pipe 28 to come out of the inner space of the valve member 30 to close same with the movable valve body 33 as shown in the drawing, whereupon the pressure in the inner chamber of the first casing 23 is lowered (to a higher vacuum), pushing valve member 30 downward. In this manner the downward and upward displacements of the valve member 30 are repeated to maintain the pressure in the inner chamber of the first casing 23 at a constant level as determined by the springs 38 and 42.

Upon energizing the coil 41 by conduction of positive polarization, bobbin 40 is raised in proportion to the value of applied current, compressing the coil spring 42 which accordingly pushes the valve member 30 upward (or in the direction of contracting the inner chamber of the first casing 23). In other words, the valve member 30 is pushed in a direction of communication the inner chamber of the first casing 23 with the inner space (atmospheric pressure) of the valve member 30 or in a direction of lowering the vacuum in the inner chamber of the first casing 23. Therefore, the greater the current of the positive conduction, the lower the vacuum becomes in the inner chamber of the first casing 23. It follows that a vacuum of a desired level can be produced at the output port 22 by controlling the applying current by the output of the aforementioned microcomputer, for application to the control port 51 of the flow control valve 50.

Flow control valve 50 which is of known construction is constituted by first casing 52 having a control port 51, a second casing 56 having an atmospheric port 53, an output port 54 and an air inlet port 55, a diaphragm 57 partitioning the inner space of the first and second casings 52 and 56 from each other, a compression coil spring 58 urging the diaphragm 57 toward the second casing 56, a valve body 59 having one end thereof secured to the diaphragm 57 and the other end disposed opposingly to the air inlet port 55, and a partition wall 60 dividing the inner space of the second casing 56 between the atmospheric port 53 and the output port 54. With this flow control valve 50, as the vacuum at the control port 51 is increased, diaphragm 57 is pulled inward of the first casing 52 against the force of the spring 58, increasing the flow rate of air from the air inlet 55 to the output port 54. On the contrary, if the vacuum at the control port 51 is lowered, diaphragm 57 is displaced inwardly to the second casing 56 by the force of the spring 58 to reduce the flow rate of air from the air inlet port 55 to the output port 54. The air inlet port 55 is supplied with the air from an air pump 70, and air which flows out through the output port 54 is injected into the exhaust manifold 6.

Although the coil winding 41 is designed to be displaced upward in the drawing in compressing the coil spring 42 in the foregoing embodiment, it may be substituted by a tension spring which has its opposite ends secured to or engaged with the valve member 30 and the coil bobbin 40, respectively. In such a case, the coil bobbin 40 is urged upward in the de-energized state of the coil 41 and moved downward upon increasing the value of conducting current (reverse conduction) through the coil 41, forcibly pulling the valve 30 downward to increase the vacuum at the output port 22, in a manner inverse to the operation of the embodiment shown in the FIGURE.

As described hereinbefore, the vacuum control valve device of the invention controls the output vacuum by varying the force of spring which is imposed on the diaphragm by means of a solenoid device, preventing air and vacuum losses while contributing to the efficient use of the working vacuum losses while contributing to the efficient use of the working vacuum and air. In addition, the vacuum control valve device integrates the constant vacuum control mechanism with the solenoid device, so that it requires a reduced number of control elements, facilitating the positioning and assembling work. On-off-duty control of the solenoid valve as discussed above occurs due to operation of a control system of a quantity of air flow flowing through the solenoid valve by changing the duty of time to energize the solenoid (time period or number of pulses of electric current for energizing the solenoid).

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An exhaust gas cleaning fluid control system including a flow control valve for metering additional air to be supplied to the exhaust manifold of an internal combustion engine in response to vacuum signals and a vacuum control valve device for producing vacuum signals to be applied to a vacuum chamber of the flow control valve, said vacuum control valve comprising;

a housing;

a diaphragm dividing said housing into a first chamber communicating with the intake manifold of the engine and second chamber communicating with the atmosphere;

a valve assembly securely fixed to a center portion of said diaphragm and having a passage intercommunicating said first and second chambers, a spring and a movable valve body biased by said spring to normally close said intercommunicating passage;

first and second spring means provided in said first and second chambers for imposing opposite forces on said valve assembly;

a solenoid device provided in said second chamber and including a movable member supporting one end of said second spring means;

a stopper adapted to push said movable valve body when said valve assembly is displaced a predetermined distance, thereby communicating said first and second chambers with each other through said passage of said valve assembly;

said housing including a port formed therein to communicate said first chamber with a vacuum chamber portion of said flow control valve; and said vacuum control valve producing in said first chamber vacuum signals proportional to the intake manifold vacuum of the engine and to on-off signals applied to said solenoid device.

2. A vacuum control valve device for use in an exhaust gas cleaning fluid control system, said vacuum control valve device comprising:

a housing;

a diaphragm dividing said housing into a first chamber communicating with the intake manifold of an internal combustion engine and a second chamber communicating with atmosphere;

a valve assembly securely fixed to a center portion of said diaphragm and having an interior passage intercommunicating said first and second chambers, a spring and a movable valve body biased by said spring to normally close said intercommunicating passage;

first spring means provided in said first chamber for pushing said valve assembly in a direction of expanding the volume of said first chamber;

second spring means provided in said second chamber for pushing said valve assembly in a direction of reducing the volume of said first chamber;

a solenoid device provided in said second chamber comprising a core and a coil, either said core and coil being fixed to said housing and the other being movable within said housing while supporting the other end of said second spring means; and a stopper of a predetermined length projecting into said first chamber from said housing for pushing said valve body of said valve assembly against spring action to open said intercommunicating passage when said diaphragm is moved in the direction of reducing the volume of said first chamber;

thereby producing in said first chamber vacuum signals responsive to the intake manifold vacuum of the engine and to on-off signals applied to said solenoid device.

3. A vacuum control valve device as set forth in claim 2, wherein said housing consist of a first housing member and a second housing member securely fixing the outer peripheral edges of said diaphragm.

4. A vacuum control valve device set forth in claim 2, said valve assembly a first comprising and second casing member each having a centrally located communicating passage and securely fixing therebetween inner peripheral edge portions of said diaphragm, said valve body being positioned in said first and second casing members along with said biasing spring and being pressed against said first casing member to close said communicating passage.

5. A vacuum control valve device as set forth in claim 4, said stopper projected from said housing being loosely positioned in said communicating passage of said first casing member.

6. A vacuum control valve device as set forth in claim 5, wherein said stopper is tubular in shape and including one end thereof being fitted into a port communicating with the intake manifold of said engine.

7. A vacuum control valve device as set forth in claim 2, further comprising a bobbin having a support means for said second spring wherein said core of said solenoid device is fixed to said housing and said coil is slidable axially of said core and mounted on said bobbin.

8. A vacuum control valve device as set forth in claim 7, a further comprising a radially polarized cylindrical ferrite secured to said housing coaxially with said coil.

* * * * *